US006724135B2

(12) United States Patent
Mayer et al.

(10) Patent No.: US 6,724,135 B2
(45) Date of Patent: Apr. 20, 2004

(54) REFLECTOR LAMP HAVING A METALLIC HOLDER

(75) Inventors: Albert Mayer, Mockenlohe (DE); Roland Stark, Wellheim (DE)

(73) Assignee: Patent-Treuhand-Gesellschaft fur elektrische Gluhlampen mbH, Munich (DE)

( * ) Notice: Subject to any disclaimer, the term of this patent is extended or adjusted under 35 U.S.C. 154(b) by 37 days.

(21) Appl. No.: 10/252,717

(22) Filed: Sep. 24, 2002

(65) Prior Publication Data

US 2003/0057813 A1 Mar. 27, 2003

(30) Foreign Application Priority Data

Sep. 24, 2001 (DE) ..... 101 46 877

(51) Int. Cl.[7] ..... H01J 5/48

(52) U.S. Cl. ..... 313/318.11; 313/318.12; 313/318.01

(58) Field of Search ..... 313/318.01, 318.03, 313/318.04, 318.08, 318.09, 318.1, 318.11, 318.12; 362/226; 439/236

(56) References Cited

U.S. PATENT DOCUMENTS 5,320,548 A * 6/1994 Schadhauser ..... 439/236

6,657,369 B1 * 12/2003 Tamaru et al. ..... 313/318.11

FOREIGN PATENT DOCUMENTS

EP 0 780 884 6/1997

* cited by examiner

*Primary Examiner*—Harshad Patel
*Assistant Examiner*—Karabi Guharay
(74) *Attorney, Agent, or Firm*—William E. Meyer

(57) ABSTRACT

A reflector lamp having a reflector which has a reflector neck and defines a reflector axis, and an electric lamp fixed in the reflector neck by a metallic holder, in which a section of the metallic holder is arranged, secured against rotations about the axis, in a cutout in the reflector neck and projects from the neck through this cutout, a shoulder in the region of the reflector neck a is designed as a depth stop for the metallic holder in the direction of the reflector axis, the lamp has a metallic base shell is provided with a thread and for which the outer wall of the reflector neck forms a stop surface, and there is a screwed connection between the base shell and the part, projecting from the reflector neck, of the section, arranged in the cutout of the reflector neck, of the metallic holder.

8 Claims, 3 Drawing Sheets

REFLECTOR LAMP HAVING A METALLIC HOLDER

I. TECHNICAL FIELD

Figure 1:
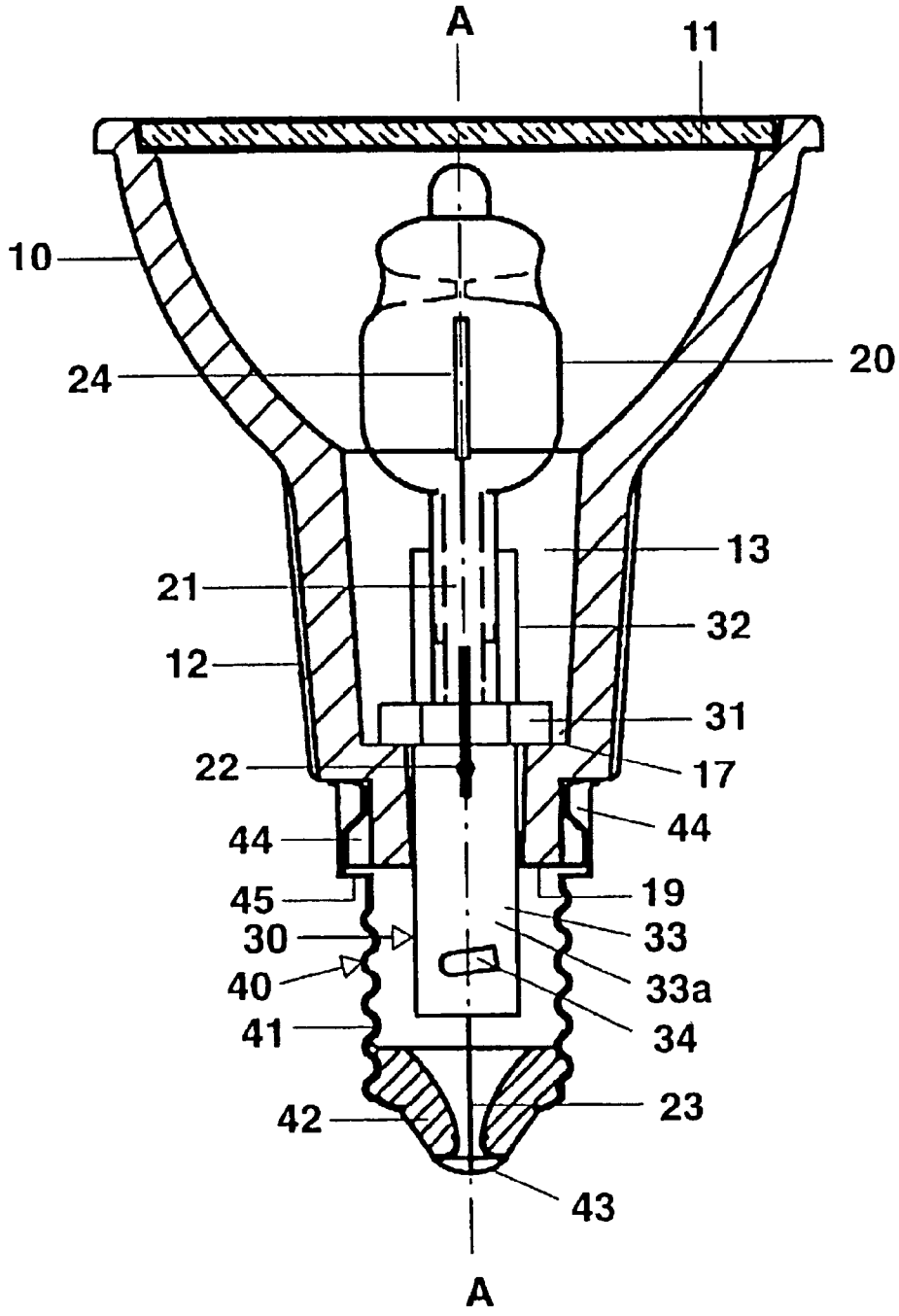

The invention relates to a reflector lamp in accordance with the preamble of patent claim 1.

II. PRIOR ART

Such a reflector lamp is described, for example, in European laid-open specification EP 0 780 884 A1. This specification discloses a lamp reflector unit with a metal spring which is fitted on the lamp and rests on the reflector. The lamp is fixed in the reflector with the aid of this mechanically stressed metal spring. This reflector lamp is a pin-type socket lamp.

III. DISCLOSURE OF THE INVENTION

It is the object of the invention to provide a reflector lamp which is fitted with a screw base and which ensures reliable holding and making of electric contact with the lamp in the reflector with the simplest possible means.

This object is achieved according to the invention by means of the features of patent claim 1. Particularly advantageous designs of the invention are described in the dependent claims.

The reflector lamp according to the invention has a reflector which has a reflector neck and defines a reflector axis, as well as an electric lamp which is fixed in the reflector neck by means of a metallic holder, in which

- a section of the metallic holder is arranged, secured against rotations about the reflector axis, in a cutout in the reflector neck and projects from the reflector neck through this cutout,
- there is arranged in the region of the reflector neck a shoulder which is designed as a depth stop for the metallic holder in the direction of the reflector axis,
- the reflector lamp has a metallic base shell which is provided with a thread and for which the outer wall of the reflector neck forms a stop surface, and
- there is a screwed connection between the base shell and the part, projecting from the reflector neck, of the section, arranged in the cutout of the reflector neck, of the metallic holder.

The metallic holder of the reflector lamp according to the invention is arranged securely against rotation in the reflector neck, and coordinated with the reflector neck and with the base shell such that upon mounting of the reflector lamp the holder and the base shell fix one another reciprocally through the cooperation of the metallic holder with the thread of the base shell and with the aid of the depth stop, arranged in the reflector neck, for the metallic holder. During the mounting of the base shell on the metallic holder, the cooperation of the metallic holder with the thread of the base shell exerts a force in the axial direction which tends to reduce the spacing between the holder and the bottom of the base shell. However, the depth stop prevents an axial movement of the holder. A force of the same magnitude, but acting in the opposite direction, is exerted on the base shell. This force likewise tends to reduce the distance between the bottom of the base shell and the holder. After being screwed onto the metallic holder, the base shell is supported on the outer wall of the reflector neck. The outer wall of the reflector neck forms a stop surface for the base shell, and thereby serves as opposing bearing to the depth stop on which the metallic holder rests. In particular, the depth of the screwed connection is determined by the above-named stop surface for the base shell and the above-named depth stop for the metallic holder. This renders it possible to fasten the base shell on the reflector neck without cement. Moreover, owing to its contact with the inner wall of the base shell, the metallic holder offers a simple possibility for making electric contact with the lamp.

The rotationally secure arrangement of the metallic holder in the reflector neck is advantageously ensured by virtue of the fact that both the shape of the cutout in the reflector neck and the section, arranged in the cutout of the reflector neck, of the metallic holder have a shape which is not rotationally symmetrical with reference to the reflector axis, and the dimensions of the cutout and of the section, arranged in the cutout, of the metallic holder, are coordinated with one another. This can be implemented in a simple way by virtue of the fact that the section, arranged in the cutout in the reflector neck, of the metallic holder is designed as a sleeve which has at least two mutually opposite side walls running parallel to one another, and the reflector neck has at least two mutually opposite inner walls in the region of its cutout, the side walls of the sleeve bearing against the inner walls. In order to fix the metallic holder in the reflector neck, it is advantageously provided with at least two lugs which are angled off perpendicular to the reflector axis and rest on the shoulder, designed as depth stop, of the reflector neck. The part, projecting from the reflector neck, of the section, arranged in the cutout of the reflector neck, of the metallic holder is advantageously provided with knobs which bear against the inner wall of the base shell and engage in the thread of the base shell. These knobs form a thread coordinated with the thread of the base shell and thereby permit a screwed connection between the base shell and the metallic holder. In order to ensure a backlash-free arrangement of the base shell on the reflector neck, the outer contour of the reflector neck is advantageously provided with a surface running obliquely relative to the reflector axis. In addition, the base shell is advantageously fixed on the reflector neck with the aid of an adhesive or by means of crimping, in order to prevent releasing of the screwed connection between the base shell and the metallic holder. The metallic holder is advantageously also used to make electric contact. For this purpose, one of the supply leads projecting from the lamp is connected in an electrically conducting fashion to the metallic holder. As a result, this supply lead makes electric contact with the thread of the base shell, while the other supply lead is connected in an electrically conducting fashion to the contact plate of the base shell.

IV. BRIEF DESCRIPTION OF THE DRAWINGS

Figure 2:
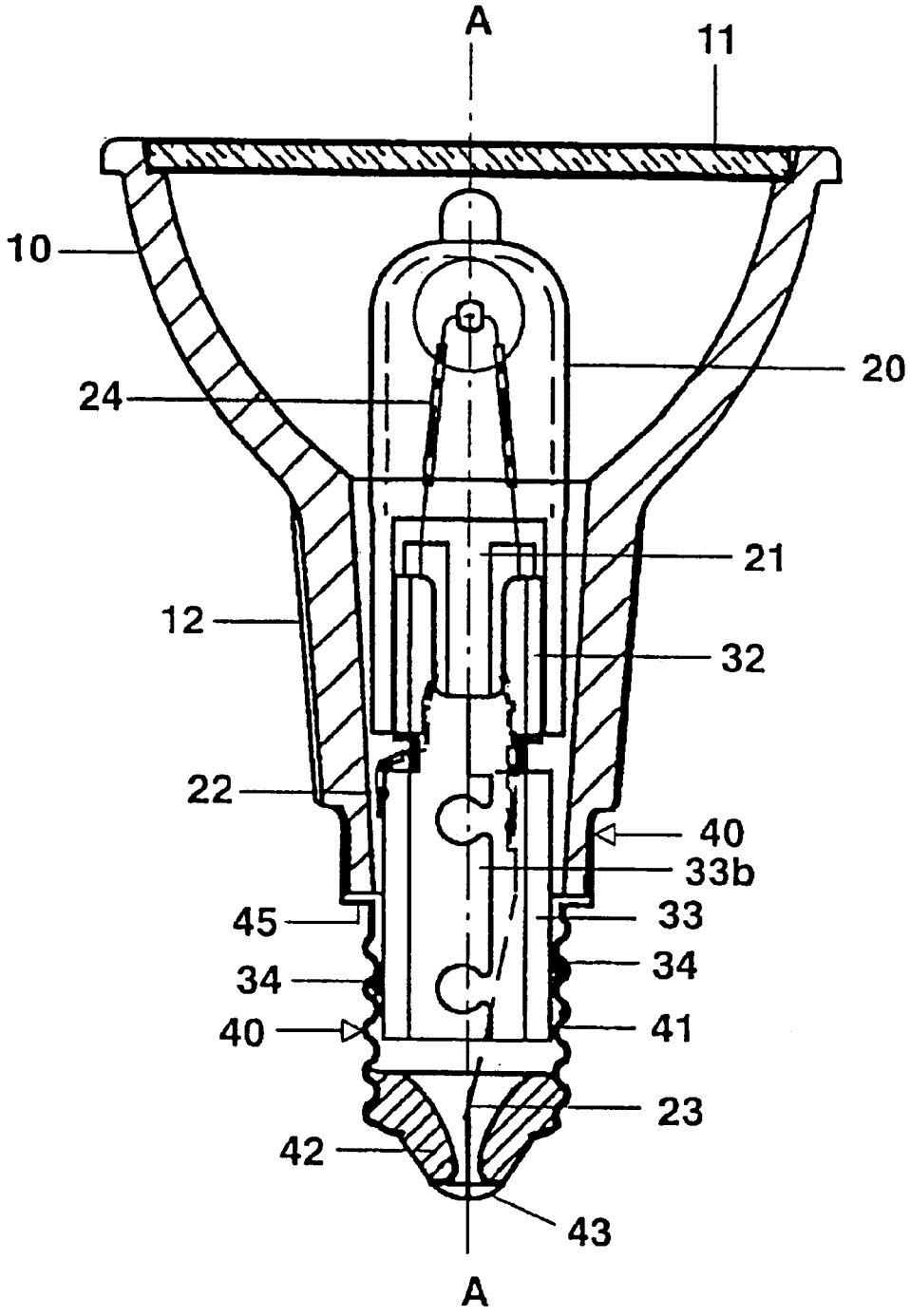
Figure 3:
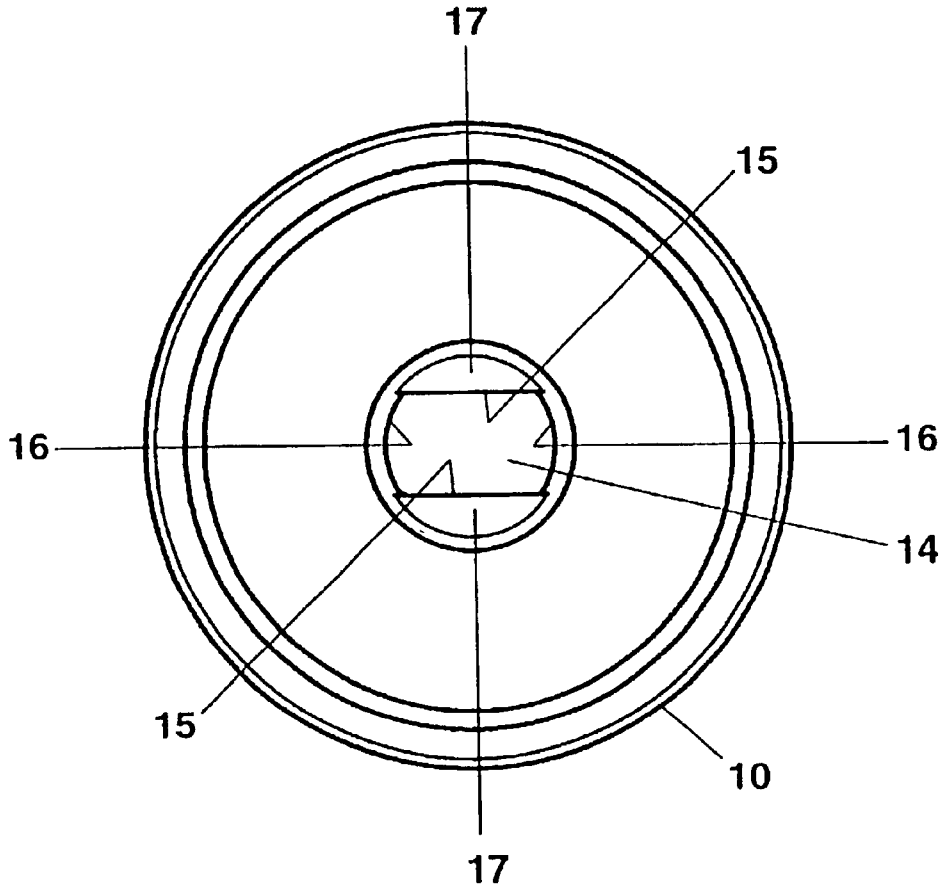

The invention is explained in more detail below with the aid of a preferred exemplary embodiment. In the drawing:

FIG. 1 shows a cross section through preferred exemplary embodiment of the reflector lamp according to the invention, FIG. 2 shows a cross section through the preferred exemplary embodiment of the reflector lamp according to the invention in a view which is rotated through 90 degrees about the reflector axis with reference to FIG. 1, FIG. 3 shows a plan view of the reflector of the reflector lamp illustrated in FIGS. 1 and 2.

V. BEST MODE FOR CARRYING OUT THE INVENTION

FIGS. 1–3 show a side view of a preferred exemplary embodiment of the reflector lamp according to the invention, in a partially sectioned illustration. This reflector lamp is provided for operating on system voltage, and has an electric power consumption of approximately 40 watts. It comprises essentially a reflector 10, a halogen incandescent lamp 20 which is fixed in the reflector 10 by means of a metallic holder 30, and an E14 screw base for supplying the lamp 20 with power. The E14 screw base is formed from the metallic base shell 40, provided with the thread 41, the base insulator 42 and the contact plate 43. The reflector 10 is designed with rotational symmetry with reference to its axis A—A, and has a light exit opening covered by means of a transparent pane 11, as well as a reflector neck 12 arranged diametrically relative to said light exit opening. The reflector neck 12 is hollow and of rotationally symmetrical design except for its end. Its inner wall is designed in a conically tapering fashion in the direction of the reflector neck. The conicity is 3 degrees with respect to the reflector axis A—A. At its end opposite the light exit opening, the reflector neck 12 has a cutout 14 deviating from the rotational symmetry. This cutout 14 is laterally bounded by two mutually opposite, flat inner walls 15 and by two mutually opposite cambered inner walls 16. The inner walls 15 constrict in a step fashion the opening of the reflector neck 12 in the region of the cutout 14 with respect to the cavity 13 of the part of the reflector neck 12 designed with rotational symmetry. Consequently, inside the reflector neck 12 the inner walls 15 respectively form a shoulder 17 which serves as a depth stop for four lugs 31, angled off perpendicular to the reflector axis A—A, of the metallic holder 30. Moreover, the two inner walls 15 are designed in the shape of a shallow wedge such that the cutout 14 tapers in the direction of the end of the reflector neck 12.

The halogen incandescent lamp 20 is aligned axially in the reflector 20. It is fastened in the cutout 14 of the reflector neck 12 by means of the metallic holder 30. For this purpose, the metallic holder 30, of unipartite design, has two clips 32, which surround the sealed pinch foot 21 of the lamp 20 with a clamping fit, and a section 33, which is designed as a sleeve and is arranged with a clamping fit in the cutout 14 and projects partially from the end of the reflector neck 12. The section 33, designed as a sleeve, of the metallic holder 30 comprises two mutually opposite, flat side walls 33*b* running parallel to one another and two further, mutually opposite cambered side walls 33*a*. The sleeve 33 therefore has a rectangular cross section in a plane perpendicular to the reflector axis A—A, the two end sides of this quadrangle being cambered, however. The two cambered side walls 33*a* of the sleeve 33 are fitted in each case with an outwardly projecting knob 34, which bear against the inner wall of the base shell 40 and engage in its thread 41. These knobs 34 form a part of a thread such that the base shell 40 can be connected by a screw connection to the sleeve 33 or to the metallic holder 30. The two flat side walls 33*b* of the sleeve 33 bear against the inner walls 15 running in a wedge-shaped fashion.

Two supply lead wires 22, 23, which serve to supply the incandescent filament 24 with power, are guided out of the lamp 20. A first supply lead wire 22 is connected in an electrically conducting fashion by a welded joint to a cambered side wall of the sleeve 33. The other supply lead wire 23 is arranged without touching the metallic holder 30 and connected in an electrically conducting fashion to the contact plate 43.

The base shell 40 is additionally fixed on the end of the reflector neck 12 by a crimp connection 44, in order to prevent loosening of the screwed connection between the metallic holder 30 and the base shell 40. In order to ensure a backlash-free arrangement of the base shell 40 on the end of the reflector neck 12, the outer contour of the reflector neck is provided with a surface running obliquely relative to the reflector axis A—A. The base shell 40 is widened in a stepwise fashion in the direction of its opening. The shoulder 45 thereby produced uses the end of the reflector neck 12 as stop surface 19.

What is claimed is:

1. A reflector lamp having a reflector which has a reflector neck and defines a reflector axis, and having an electric lamp which is fixed in the reflector neck by means of a metallic holder, wherein a section of the metallic holder is arranged, secured against rotations about the reflector axis, in a cutout in the reflector neck and projects from the reflector neck through this cutout, there is arranged in the region of the reflector neck a shoulder which is designed as a depth stop for the metallic holder in the direction of the reflector axis, the reflector lamp has a metallic base shell which is provided with a thread and for which the outer wall of the reflector neck forms a stop surface, and there is a screwed connection between the base shell and the part, projecting from the reflector neck, of the section, arranged in the cutout of the reflector neck, of the metallic holder.

2. The reflector lamp as claimed in claim 1, wherein both the shape of the cutout in the reflector neck and the section, arranged in the cutout of the reflector neck, of the metallic holder have a shape which is not rotationally symmetrical with reference to the reflector axis, and the dimensions of the cutout and of the section are coordinated with one another.

3. The reflector lamp as claimed in claim 1, wherein the section, arranged in the cutout in the reflector neck, of the metallic holder is designed as a sleeve which has at least two mutually opposite side walls running parallel to one another, and the reflector neck has at least two mutually opposite inner walls in the region of its cutout, the abovementioned side walls of the sleeve bearing against the inner walls.

4. The reflector lamp as claimed in claim 1, wherein the metallic holder has at least two lugs which are angled off perpendicular to the reflector axis and bear against the shoulder.

5. The reflector lamp as claimed in claim 1, wherein the part, projecting from the reflector neck, of the section, arranged in the cutout in the reflector neck, of the metallic holder has knobs which bear against the inner wall of the base shell and engage in the thread of the base shell.

6. The reflector lamp as claimed in claim 1, wherein the outside of the reflector neck is provided with a surface running obliquely with reference to the reflector axis.

7. The reflector lamp as claimed in claim 1, wherein the base shell is fixed on the reflector neck by an adhesive or by a crimp connection.

8. The reflector lamp as claimed in claim 1, wherein a first supply lead, projecting from the lamp, is connected in an electrically conducting fashion to the metallic holder, and a second supply lead, projecting from the lamp, is connected in an electrically conducting fashion to a contact plate of the base shell.

* * * * *